US009346570B2

(12) United States Patent
Williams

(10) Patent No.: US 9,346,570 B2
(45) **Date of Patent: *May 24, 2016**

(54) METHOD AND APPARATUS FOR POUCHING TOBACCO HAVING A HIGH MOISTURE CONTENT

(71) Applicant: Philip Morris USA Inc., Richmond, VA (US)

(72) Inventor: Dwight D. Williams, Powhatan, VA (US)

(73) Assignee: PHILIP MORRIS USA INC., Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/100,599

(22) Filed: Dec. 9, 2013

(65) Prior Publication Data

US 2014/0157728 A1 Jun. 12, 2014

Related U.S. Application Data

(63) Continuation of application No. 13/071,959, filed on Mar. 25, 2011, now Pat. No. 8,602,068.

(60) Provisional application No. 61/318,212, filed on Mar. 26, 2010.

(51) Int. Cl.
*B65B 37/14* (2006.01)
*B65B 7/00* (2006.01)
(Continued)

(52) U.S. Cl.
CPC ... *B65B 7/00* (2013.01); *B65B 1/16* (2013.01); *B65B 9/20* (2013.01); *B65B 29/00* (2013.01); *B65B 37/14* (2013.01); *B65B 37/20* (2013.01)

(58) Field of Classification Search
CPC ..... B65B 1/16; B65B 1/36; B65B 31/04; B65B 37/14; B65B 7/00
USPC ..... 141/71–75, 79, 144–152; 131/4, 49, 131/110–119; 222/1, 152
See application file for complete search history.

(56) References Cited

U.S. PATENT DOCUMENTS 3,656,518 A * 4/1972 Aronson ..... 141/1
3,847,191 A * 11/1974 Aronson ..... 141/12
(Continued)

FOREIGN PATENT DOCUMENTS

EP 319131 A1 * 6/1989 ..... B65B 1/36
WO WO 83/02434 A1 7/1983
(Continued)

OTHER PUBLICATIONS

International Search Report and Written Opinion mailed Sep. 28, 2011 for PCT/IB2011/000986.
(Continued)

*Primary Examiner* — Mark A Laurenzi
*Assistant Examiner* — Andrew Schmid
(74) *Attorney, Agent, or Firm* — Buchanan Ingersoll & Rooney PC

(57) ABSTRACT

An apparatus for dispensing charges of high OV moist smokeless tobacco (MST) includes a rotary metering device. The rotary metering device includes a lower disk, a metering disk, a plurality of cavities in the metering disk; and at least one vacuum housing located around the periphery of the lower disk and in communication with the plurality of cavities. A vacuum is applied to the cavities to aid in the filling of the cavities and an air discharge mechanism ejects a charge of the MST from each cavity at a discharge station.

16 Claims, 4 Drawing Sheets

(51) Int. Cl.

| | |
|---|---|
| ***B65B 9/20*** | (2012.01) |
| ***B65B 29/00*** | (2006.01) |
| ***B65B 37/20*** | (2006.01) |
| ***B65B 1/16*** | (2006.01) |

(56) References Cited

U.S. PATENT DOCUMENTS

| | | | | |
|---|---|---|---|---|
| 4,111,212 | A * | 9/1978 | Bakker | 131/108 |
| 4,135,615 | A * | 1/1979 | Brackmann et al. | 198/371.3 |
| 4,509,568 | A * | 4/1985 | Kawaguchi et al. | 141/129 |
| 4,671,430 | A * | 6/1987 | Dinius | 222/135 |
| 4,703,765 | A * | 11/1987 | Paules et al. | 131/112 |
| 4,811,746 | A * | 3/1989 | Davis | 131/359 |
| 4,862,905 | A * | 9/1989 | Green et al. | 131/84.1 |
| 4,949,766 | A | 8/1990 | Coatsworth | |
| 5,012,629 | A * | 5/1991 | Rehman et al. | 53/453 |
| 5,083,577 | A * | 1/1992 | Cullen | 131/109.2 |
| 5,167,244 | A * | 12/1992 | Kjerstad | 131/359 |
| 5,322,074 | A * | 6/1994 | Cross, Jr. | 131/110 |
| 5,339,871 | A * | 8/1994 | Collins et al. | 141/1 |
| 5,722,217 | A * | 3/1998 | Cloud | 53/455 |
| 5,927,052 | A * | 7/1999 | Nippes et al. | 53/445 |
| 6,135,120 | A * | 10/2000 | Lofman et al. | 131/112 |
| 6,982,094 | B2 * | 1/2006 | Sowden | 424/489 |
| 8,151,802 | B2 * | 4/2012 | Boldrini | 131/112 |
| 2004/0020554 | A1 | 2/2004 | Smith et al. | |
| 2007/0012328 | A1 * | 1/2007 | Winterson et al. | 131/347 |
| 2007/0095356 | A1 | 5/2007 | Winterson et al. | |
| 2007/0122526 | A1 * | 5/2007 | Sweeney et al. | 426/77 |
| 2007/0261707 | A1 * | 11/2007 | Winterson et al. | 131/352 |
| 2010/0252056 | A1 * | 10/2010 | Gruss et al. | 131/112 |
| 2010/0300464 | A1 * | 12/2010 | Gee et al. | 131/275 |
| 2011/0232232 | A1 * | 9/2011 | Rinehart et al. | 53/410 |
| 2011/0277878 | A1 * | 11/2011 | Williams | 141/65 |
| 2012/0000165 | A1 * | 1/2012 | Williams | 53/467 |
| 2012/0017542 | A1 * | 1/2012 | Williams et al. | 53/456 |
| 2012/0023874 | A1 * | 2/2012 | Garthaffner et al. | 53/547 |
| 2012/0031414 | A1 * | 2/2012 | Atchley et al. | 131/118 |

FOREIGN PATENT DOCUMENTS

| | | | | |
|---|---|---|---|---|
| WO | WO 95/16609 | A1 | 6/1995 | |
| WO | 2007-138487 | A2 | 12/2007 | |
| WO | WO 2008/114122 | A2 | 9/2008 | |
| WO | WO 2009/021855 | A1 | 2/2009 | |
| WO | WO 2009021855 | A1 * | 2/2009 | B65D 77/22 |
| WO | WO 2009/047627 | A1 | 4/2009 | |
| WO | WO 2009047627 | A1 * | 4/2009 | B65B 39/00 |

OTHER PUBLICATIONS

International Preliminary Report on Patentability mailed Oct. 11, 2012 for PCT/IB2011/000986.

The extended European Search Report issued on May 13, 2015, by the European Patent Office in corresponding European Application No. 14152117.9. (6 pages).

* cited by examiner

METHOD AND APPARATUS FOR POUCHING TOBACCO HAVING A HIGH MOISTURE CONTENT

CROSS REFERENCE TO RELATED APPLICATION

This application is a continuation application of U.S. application Ser. No. 13/071,959 entitled METHOD AND APPARATUS FOR POUCHING TOBACCO HAVING A HIGH MOISTURE CONTENT, filed Mar. 25, 2011 which claims priority under 35 U.S.C. §119(e) to U.S. Provisional Application No. 61/318,212, filed on Mar. 26, 2010, the entire content of each is incorporated herein by reference thereto.

WORKING ENVIRONMENT

This disclosure generally relates to method and apparatus for handling moist smokeless tobacco (MST) products. More particularly, the invention relates to method and apparatus for precision dispensing of MST.

With conventional machines, methods for dosing and pouching MST include drying, pouching, rewetting and/or flavoring the MST, and then packaging the pouches for delivery to consumers. Typically, unless the MST is first dried, the MST cannot be accurately dosed or dispensed and then pouched on conventional pouching machines because the high moisture content of the tobacco causes clumping and non-uniform delivery of tobacco to the pouches. After drying, the MST is typically pouched and then rewetted. However, rewetting after pouching causes MST to clump, which causes non-uniform flavor delivery due to the higher density of the clumps within the pouch as compared to non-clumped portions of MST contained within the pouch. In addition, when the MST has been dried, the flavor and organoleptic characteristics may be undesirably changed when compared to loose, fibrous MST. Thus, it is desirable to pouch MST using a method and apparatus that can provide more uniform and accurate dosing of MST from a dosing cavity without the need for drying and/or rewetting steps.

There has existed a need for a method and apparatus for accurately dosing MST that obviates the need for drying MST prior to pouching, substantially reduces or prevents the need for rewetting MST after pouching, and provides substantially accurate dosing of oral tobacco pouch products.

SUMMARY

An apparatus for dispensing moist smokeless tobacco includes a rotary metering device. In a preferred embodiment, the rotary metering device includes a lower disk which rotates in a horizontal plane and includes a plurality of through openings, a metering disk which rotates in a horizontal plane, and includes a plurality of through openings aligned with the plurality of through openings in the lower disk so as to define a plurality of cavities, pins mounted in the through openings of the lower disk and extending into the through openings of the metering disk and a vacuum housing located around the periphery of the lower disk and applying a vacuum to the cavities during loading of the cavities but not applying vacuum to the cavities when at the discharge station. Preferably, the pins have an upper screen defining bottoms of the plurality of cavities within the metering disk. Also preferably, the pins are vertically movable within the metering disk to raise and lower the screen so as to increase or decrease a fill volume of the plurality of cavities. Moreover, the rotary metering device includes a bowl surrounding the metering disk and adapted to hold a quantity of to be loaded into the cavities.

Preferably, the vacuum housing is in communication with the plurality of cavities so as substantially completely fill the cavities with MST during loading. In the preferred embodiment, the vacuum housing applies vacuum pressure in the cavities in an amount less than about 1 inch mercury, preferably about ⅛ inch mercury to about ¾ inch mercury, more preferably at or about ½ inch mercury. Preferably, the vacuum housing is connected to a frame and is stationary during rotation of the lower disk and metering disk. In the preferred embodiment, the rotary metering device includes two vacuum housings separated by at least two gaps which provide two applications of vacuum pressure to the cavities during rotation of the metering disk.

In the preferred embodiment, the apparatus also includes a hopper for containing moist smokeless tobacco prior to delivery to the bowl of the rotary metering device and a tobacco feed drive system for conveying moist smokeless tobacco from the hopper to the rotary metering device. In the preferred embodiment, when one of the cavities is at the discharge station, a charge of MST in the cavity is discharged from the cavity via a discharge opening, which leads to a feed tube. Preferably, the feed tube communicates with the cavity for delivering a charge of loose moist smokeless tobacco from the rotary metering device to a pouching apparatus.

Also preferably, the discharge opening comprises a stationary funnel adjacent the upper surface of the metering disk. The outer surface of the funnel aids in skimming excess MST off the top of each cavity as the metering disk rotates thereunder. When the metering disk rotates such that the funnel is positioned over one of the cavities, the funnel directs the MST to the feed tube via an air blast. A blast of air from an air discharge mechanism, which is in fluid communication with the cavity at the discharge station effects discharge of MST from the cavity and into the feed tube. Also preferably, the feed tube comprises at least one pressure release hole to allow pressurized air to escape the feed tube during ejection of MST from the cavity. The pressure release hole can be opened as needed to aid in passing the MST through the feed tube and to the pouching apparatus.

Also provided is a method of pouching moist smokeless tobacco. The method includes loading moist smokeless tobacco (MST) with a moisture content greater than about 30% into a cavity in a rotatable metering disk, applying a vacuum to the cavity so as to substantially fill the cavity as the cavity rotates to a discharge station and removing the MST from the cavity at the discharge station. Preferably, the method can also include conveying moist smokeless tobacco to a reservoir such as a bowl above the metering device wherein the MST can fill the cavities via gravity and under action of the vacuum applied to the cavity. A charge of moist smokeless tobacco can be ejected from the cavity and delivered to a pouching apparatus through a feed tube. Also preferably, the method can include placing the charge of moist smokeless tobacco in a pouch and sealing the pouch to contain the moist smokeless tobacco therein and form an oral tobacco pouch product.

DETAILED DESCRIPTION

Figure 1:
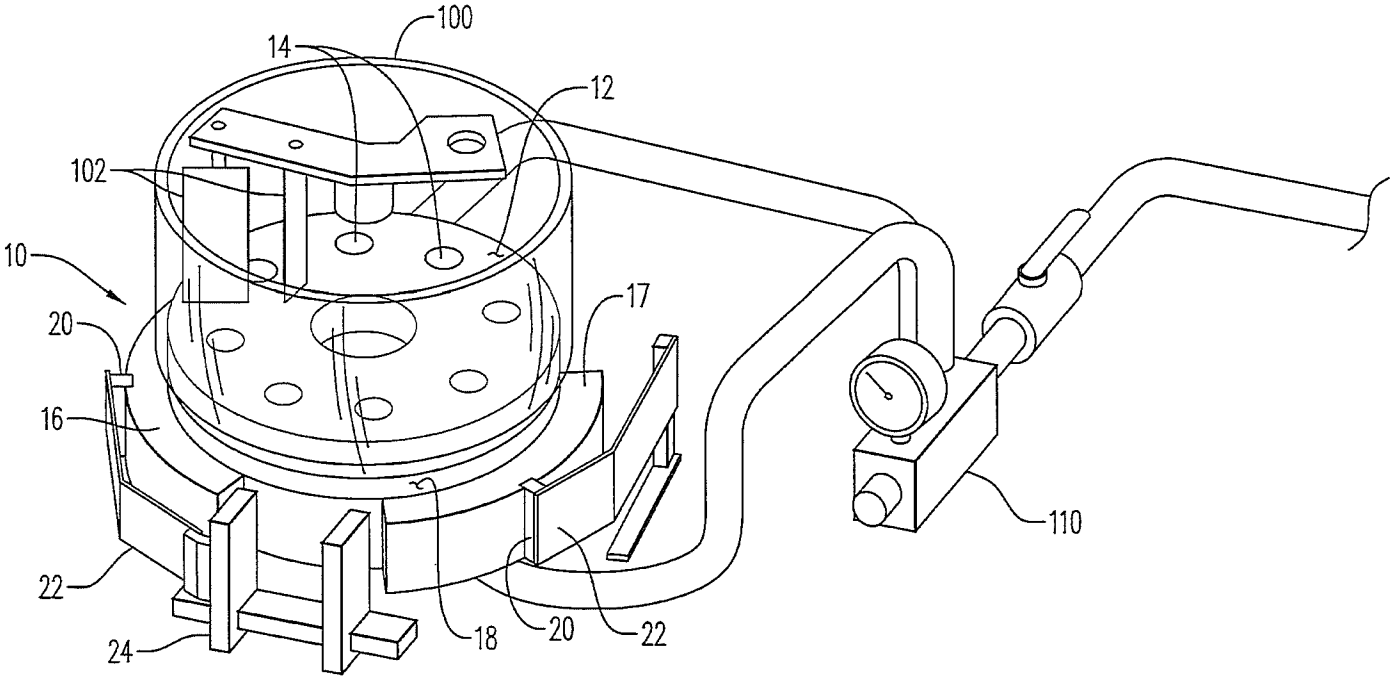
FIG. 1 is a perspective view of a rotary metering device for repeatedly and consistently feeding predetermined amount of high OV tobacco to a pouching apparatus.

A method and apparatus for uniformly pouching high OV tobacco is provided herein that is capable of repeatedly and consistently feeding a predetermined amount of high OV tobacco, such as moist smokeless tobacco (MST) having a moisture content of at least about 35% to about 50% or more and/or doing the same with tobacco that is tacky and difficult to feed with conventional devices, because of the presence of elevated levels of humectants, flavors, or other additives in the tobacco. Also preferably, the apparatus includes a feed system for delivering a substantially accurate quantity of moist smokeless tobacco to individual pouch wrappers in the course of their manufacture. The feed system includes a rotary metering device having at least one vacuum housing which applies a slight vacuum to cavities in a metering disk to draw a uniform amount of MST into each cavity. The vacuum is not applied at a discharge station where MST is sequentially ejected from the cavities into a feed tube for delivery of predetermined portions to the pouching apparatus at the discharge station.

As used herein, the term "moist smokeless tobacco" ("MST") refers to loose, fibrous leaf tobacco that is optionally fermented and/or optionally flavored. Preferably, the MST includes a blend of tobaccos that are cut, optionally fermented, optionally pasteurized, and/or optionally flavored. With practice of teachings herein, the MST can be fed into pouches without being dried and/or rewetted so as to substantially avoid altering the flavor and/or organoleptic properties of the MST after processing and placement in pouched products for oral use. Preferably, the MST is in the form of fine cut, loose tobacco fibers having short strands ranging in length from about 0.2 mm to about 15 mm (e.g., about 0.2 mm to about 12 mm, about 0.5 mm to about 10 mm, about 1.0 mm to about 8 mm, about 2.0 mm to about 6.0 mm, or about 3.0 mm to about 5.0 mm) and having a width of about 0.2 mm to about 2.5 mm (e.g., about 0.2 mm to about 2.0 mm, about 0.5 mm to about 1.5 mm, or about 0.75 mm to about 1.0 mm).

As used herein, the term "fermented" refers to the transformation of a material (such as tobacco) using one or more microorganisms, such as bacteria.

As used herein, the value of "oven volatiles" or "OV" is determined by placing a weighed sample of moist botanical material in an air-circulating oven and maintaining the sample in the oven, at a temperature of 100° C., for a period of three hours, after which the sample is again weighed. The difference in the two weight values expressed as a percentage of the original weight is defined as "oven volatiles" or "OV." Oven volatiles include water and anything that boils at a temperature of less than about 100° C.

In a preferred embodiment, an apparatus for pouching moist smokeless tobacco includes a feed system for accurately, consistently, and repetitively dosing or dispensing a predetermined quantity of MST to a pouching apparatus, such as the pouching apparatus sourced from Merz Verpackungsmaschinen GmbH, Lich, Germany, described in commonly assigned U.S. Patent Application Publication No. 2007/0261707, filed May 2, 2006, the entire content of which is incorporated herein by reference thereto. In the preferred embodiment, the pouching apparatus forms individual pouches, places a predetermined quantity of MST in each pouch, and forms at least one seal to contain the MST within the pouch so as to form an oral tobacco pouch product.

In the preferred embodiment, the apparatus includes a feed system that is designed to accurately dose MST so that a predetermined amount (charge) of MST is delivered to the pouching apparatus for placement in a pouch. Preferably, the feed system includes a hopper for containing or holding a supply of MST prior to conveyance to the rotary metering device. In the preferred embodiment, the tobacco feed drive is connected to a controller, which operates the tobacco feed drive.

As shown in FIG. 1, a rotary metering device 10 for repeatedly and consistently feeding predetermined amount of high OV tobacco to a pouching apparatus includes a bowl 100 and a rotatable metering disk 12. In the preferred embodiment, a bowl 100, open at the bottom, is positioned above the metering disk 12 and is adapted to hold a quantity of MST for delivering to the cavities 14. A pair of diverter plates 102 prevent the MST within the bowl from entering a discharge station 72 (shown in FIG. 3). Preferably, the bowl 100 rotates with the metering disk 12 and the lower disk 18.

In the preferred embodiment, the metering disk 12 includes a plurality of vertically extending through holes. Also preferably, the plurality of vertically extending through holes define cavities 14 within the metering disk 12. For example, the metering disk 12 can include eight substantially cylindrical cavities 14 therein. Preferably, each cavity 14 is designed to hold a predetermined amount of MST.

Also preferably, the metering disk 12 overlies and is connected to a rotatable lower disk 18, which rotates in unison with the metering disk 12. Preferably, through holes extend through the lower disk 18 and are aligned with the through holes in the metering disk 12. A series of pins 38 (shown in FIGS. 2A and 2B) are fixed in each of the through holes of the lower disk 18 and extend into the aligned through holes in the metering disk 12, such that an upper screen 36 of each pin 38 forms the bottom of each of the plurality of cavities 14. Also preferably, the lower disk 18 includes eight radially directed passages 28 at spaced locations along the periphery of the lower disk 18. Each radial passage 28 leads to each through hole in the lower disk 18 which receives one of the pins 38.

Figure 2A:
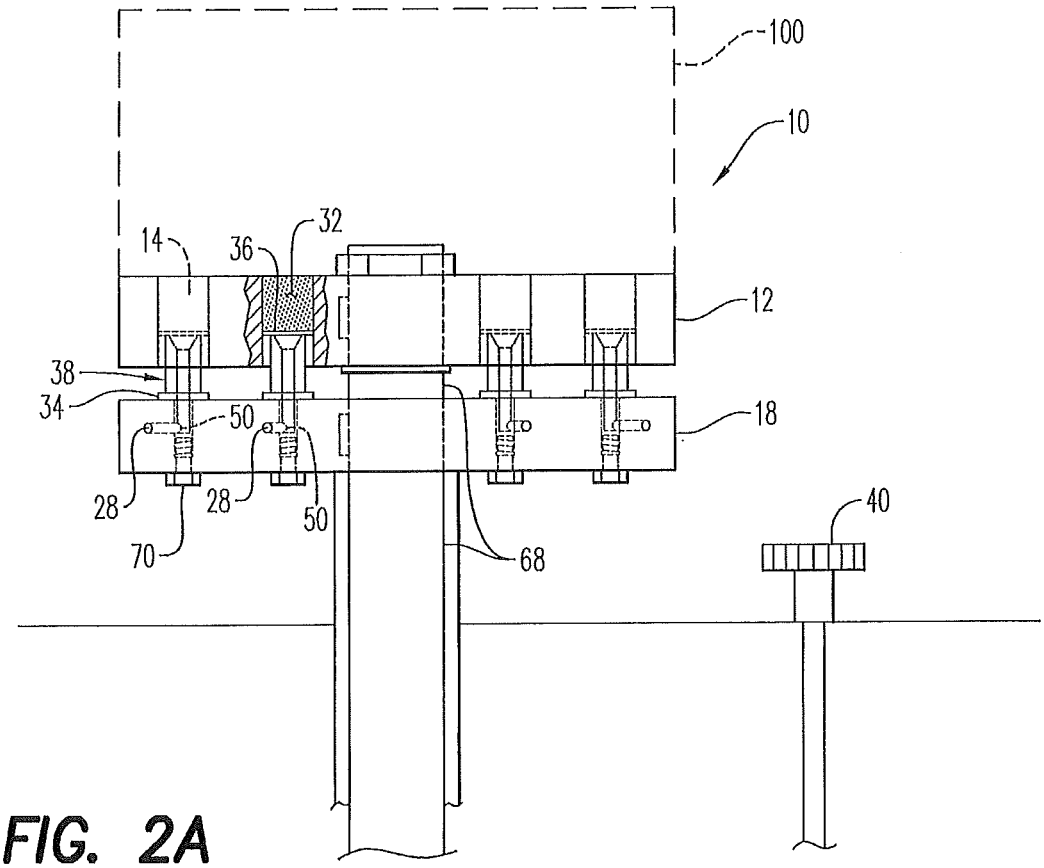
FIGS. 2A and 2B are illustrations of a side of a rotary metering device.
Figure 2B:
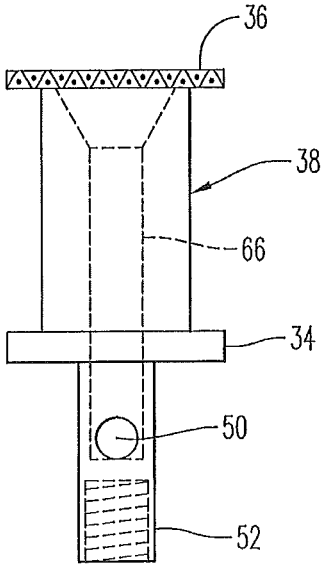

As shown in FIG. 2A, the pins 38 are fixed in the lower disk 18 and extend into the metering disk 12. As shown in FIG. 2B, each pin 38 includes an air channel 66 through an interior thereof. In the preferred embodiment, the air channel 66 communicates through lateral port or hole 50 with a respective one of the radial passages 28 of the lower disk 18. Communication of vacuum for loading MST and blasts (pulses) of air for ejecting MST are provided to the cavities 14 in the metering disk 12 via the opening 28 and air channel 66.

In the preferred embodiment, the pins also include the screen 36 at the top of each pin 38, a shoulder 34, and a interior threading at the end 52 for receiving a bolt. In operation, each pin 38 is fixed to the lower disk 18 and extends into the aligned through opening in the metering disk 12. Preferably, the pins 38 can be moved vertically within the metering disk 12 to adjust the volume of the cavities 14 via the location of the screen 36, which forms the bottom of each of the cavities 14. Also preferably, each pin 38 is connected to the lower disk 18 by a bolt 70 (shown in FIG. 2A).

Also preferably, to adjust the location of the screens 36 the metering disk 12 can be moved vertically in relation to the lower disk 18 by adjusting a shaft 68 via a knob 40, which raises and lowers the metering disk 12 in relation to the lower disk 18. By adjusting the distance between the lower disk 18 and the metering disk 12, the cavity 14 fill volume 32 can be adjusted as the position of the screen 36 moves vertically within the through holes in the metering disk 12. Thus, by moving the disks 12, 18 farther apart, the fill volume 32 can be increased while moving the disks 12, 18 closer together will decrease the fill volume 32. Preferably, the drive shaft 68 is at the center axis of each of the lower disk 18 and the metering disk 12.

Preferably, the rotary metering device also includes at least one vacuum housing. In the preferred embodiment, two vacuum housings 16, 17 (shown in FIG. 3) lie on opposite sides of the lower disk 18. Also preferably, the vacuum housings 16, 17 are held in place by a key 20 which fits on a clip 22 attached to the frame 24 of the metering device 10. The key 20 and clip 22 system prevent the vacuum housings 16, 17 from rotating with the metering disk 12 and the lower disk 18 during use so as to hold the vacuum housings 16, 17 in a stationary position. The clips 22 bias the vacuum housings 16, 17 against the sides of the lower disk 18.

Figure 3:
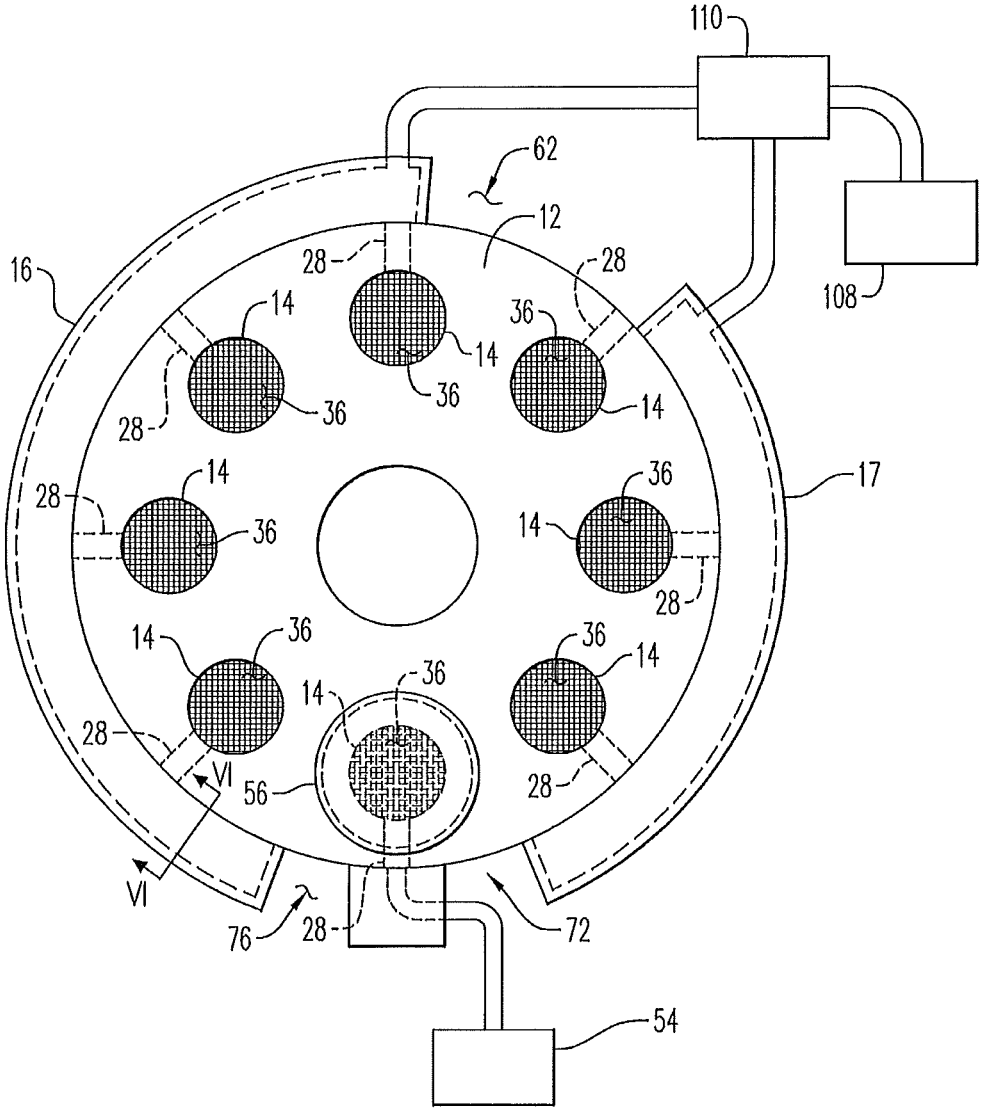
FIG. 3 is a top view of the rotary metering device.

In the preferred embodiment, as shown in FIG. 3, as MST is delivered to the cavities 14 at rotational positions other than the discharge station, a slight vacuum is applied to the cavities 14 to pull the MST therein and substantially fill the cavities 14. Preferably, the first vacuum housing 16 provides a first vacuum and the second vacuum housing 17 provides a second vacuum to the cavities after cessation of the first vacuum. By applying vacuum at two different times, the MST is given time to relax between pressure applications so as to avoid compacting the MST too much within each cavity 14 and/or delivering compacted MST to the pouching apparatus. Preferably, about ⅛ to about ¾ inch mercury vacuum is applied to each cavity 14 by each vacuum housing 16, more preferably about ¼ inch mercury to about ½ inch mercury vacuum can be applied. If too much vacuum is applied, the MST has a tendency to stick to the bottom and/or walls of the cavity 14.

Figure 4:
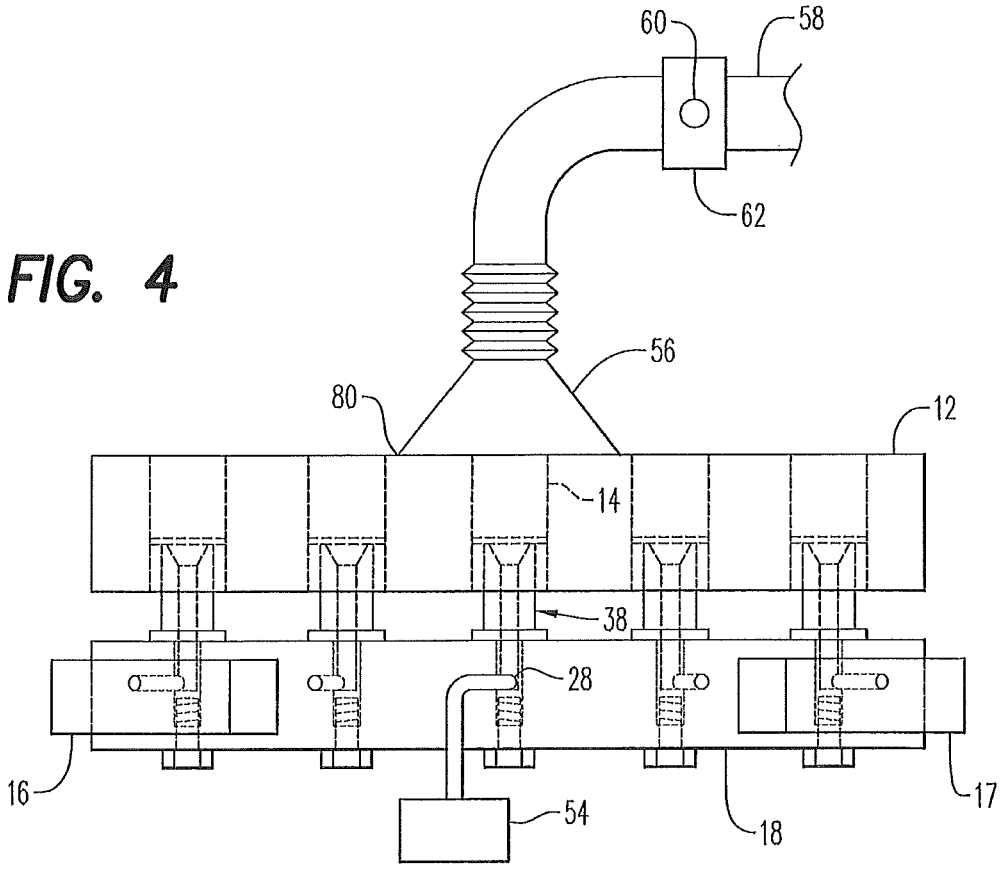
FIG. 4 is a detailed side view of the rotary metering device and feed line leading to a pouching apparatus.

As shown in FIG. 4, two semi-annular vacuum housings 16, 17 are preferably diametrically opposed on the periphery of the lower disk 18 of the rotary metering device and are arranged so that two gaps 62, 76 separate adjacent ends of the vacuum housings 16, 17. As each cavity 14 is filled, it is rotated towards the discharge station 72. At the discharge position 72, MST is removed from the cavity 14 and directed to an overlying feed line 58 by a funnel 56. The feed line 58 supplies MST to a pouching apparatus. In the preferred embodiment, the outer surface 80 of the funnel 56 is biased against the upper surface of the metering disk 12 and aids in skimming excess MST off the top of each cavity 14 as the metering disk 12 passes thereunder to promote consistent delivery of accurate charges of MST to the pouching apparatus. Once the funnel 56 is positioned over one of the cavities 14, the funnel 56 directs the MST to the feed tube 58. A timed pulse of compressed air (air blast) from a controlled source 54 is directed into the cavity 14 at the discharge position 72 via the respective radial hole 28 of the lower disk 12, the port 50 and the air channel 66 of the respective pin 38 and through its screen 36. The pulse of compressed air ejects the MST from the cavity 14, through the funnel and into the feed tube 58.

Preferably, the feed tube 58 comprises at least one pressure release hole 60 and a rotatable closure ring 62 having an aperture to adjust the size of the opening and closure of the pressure release hole 60. The pressure relief hole 60 is opened incrementally if the MST is found to clump in the pouch until it is found that the MST is more uniformly distributed within the pouch. Preferably, the pressure release hole 60 is about ⅛ inch in diameter.

In the preferred embodiment, as discussed above, gaps 62, 76 may lie between the vacuum housings 16, 17. The gaps 62, 76 are positioned such that vacuum pressure is not applied when each cavity 14 is positioned adjacent the gaps 62, 76. Thus, the MST is allowed to relax between applications of vacuum as the bowl 100 rotates through the gap 62 so as to allow for substantially uniformly filled cavities. The interruption of vacuum is believed to help prevent the MST from being delivered to a pouch in an overly compacted condition.

In operation, tobacco of high moisture content is loaded into the bowl 100 which undergoes rotation together with the metering disk 12 and the lower disk 18. As an empty metering cavity 14 is rotated beyond the discharge station (position) 72, vacuum is communicated to the metering cavity 14 as it rotates through the angular positions in communication with vacuum applied by the vacuum housings 16.

Figure 5:
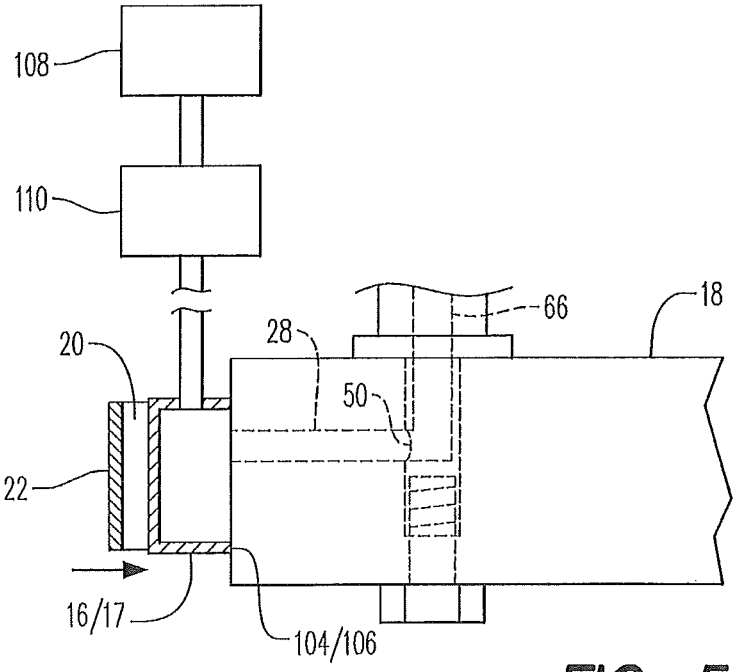
FIG. 5 is a cross-sectional view in the direction of line VI-VI.

Referring now to FIG. 5, each vacuum housing 16, 17 includes arcuate bearing edge surfaces 104,106 which conform with the periphery of the lower disk 18. The body of the vacuum housings 16, 17 are urged against the periphery of the lower disk 18 by the key 20 and clips 22. Preferably the vacuum housings 16, 17 are constructed of a hard plastic. The hollow interiors of the vacuum housings 16, 17 are communicated with a source of vacuum 108 through a pressure regulator 110 such that the vacuum may be adjusted to the aforementioned desired levels (less than one inch mercury).

Although it is preferred to use two vacuum housings 16, 17, a single vacuum housings 16 might be employed instead. The use of two (2) vacuum housings 16, 17 facilitates placement and removal of the vacuum housings 16, 17 for cleaning or other purposes.

In a preferred embodiment, a method of pouching moist smokeless tobacco material includes loading MST into a cavity in a rotatable metering disk, applying a vacuum to each cavity so as to substantially fill the cavity as the cavity rotates to a discharge station, and removing the MST from the cavity at the discharge station. Preferably, at the discharge station, the quantity of moist smokeless tobacco is ejected from the cavity through a funnel leading to a feed tube. Preferably, the method also includes conveying the moist smokeless tobacco to a reservoir above the metering disk using a tobacco feed drive system. In the preferred embodiment, the method can also include delivering the predetermined quantity of moist smokeless tobacco (MST) to a pouching apparatus using a feed tube. Moreover, the method can include placing the predetermined quantity of moist smokeless tobacco in a pouch and sealing the pouch to contain the predetermined quantity of moist smokeless tobacco therein and form a tobacco pouch product for oral use.

The pouch forming operations can be executed by feeding a ribbon of porous outer web material through a poucher machine, such as those manufactured by Merz Verpackungsmaschinen GmbH, Lich, Germany. Such systems typically include a folding horn or shoe, a cutter and a feeder, which cooperate to repetitively fold the ribbon of porous outer web into a tube, close-off and seal an end portion of the tube, feed a measured amount of MST into the closed-off tube to create a filled portion of the tube and seal and sever the filled portion of the tube to repetitively form individual pouch products.

The disclosed embodiment is particularly suited for dispensing botanical material of high moisture content such as MST tobacco of 35% to about 50% moisture of more. The tacky nature of such materials requires the application of vacuum on the metering cavities to achieve consistent loading of the cavities because gravity alone is not sufficient. However, too much vacuum will tend to cause the botanical material to stick to the screen 36 and interferes with proper functioning of the feeder.

Additionally, such material when discharged into the funnel 56 tends to clump together to form a bolus instead of entraining with the pulse of compressed air as does a drier material. To counteract this tendency, pressure is partially relieved at a location along the feed tube via a partial or complete opening of the hole 60. The tendency of the material to form a bolus is reduced and the material is more uniformly distributed along the pouch.

As used herein, the term "about" when used in conjunction with a stated numerical value or range denotes somewhat more or somewhat less than the stated value or range, to within a range of ±10% of that stated.

In this specification the words "generally" and "substantially" are sometimes used. When used with geometric terms, the words "generally" and "substantially" are intended to encompass not only features which meet the strict definitions but also features which fairly approximate the strict definitions.

While the foregoing describes in detail a preferred apparatus and methods for pouching moist smokeless tobacco with reference to a specific embodiment thereof, it will be apparent to one skilled in the art that various changes and modifications may be made to apparatus and equivalent methods may be employed, which do not materially depart from the spirit and scope of the foregoing description. Accordingly, all such changes, modifications, and equivalents that fall within the spirit and scope of the appended claims are intended to be encompassed thereby.

I claim:

1. An apparatus for dispensing a charge of moist smokeless tobacco (MST), said apparatus comprising:

a rotary metering device, said rotary metering device comprising:

a rotatable lower disk rotatable about a vertical axis, said lower disk comprising a plurality of through openings;

a rotatable metering disk rotatable about the vertical axis, said metering disk comprising a plurality of vertically extending through openings aligned with the plurality of through openings in the lower disk so as to define a plurality of cavities;

pins mounted in the through openings of the lower disk and extending into the vertically extending through openings of the metering disk, said pins having an upper screen defining bottoms of the plurality of cavities within the metering disk;

a vacuum source adapted to supply a vacuum force to the cavities during loading of the cavities;

a reservoir above the metering disk adapted to supply MST to the cavities during loading of the cavities; and, an air discharge mechanism adapted to apply a blast of compressed air to each of the cavities when at a discharge station to eject a charge of MST therefrom.

2. The apparatus of claim 1, further including a discharge opening and a feed tube positioned at a discharge station at which the air discharge mechanism delivers the charge of MST from a cavity in the rotary metering device to a pouching apparatus.

3. The apparatus of claim 2, wherein the discharge opening comprises a funnel biased against an upper surface of the metering disk and in communication with the feed tube.

4. The apparatus of claim 2, wherein the feed tube comprises at least one pressure release hole.

5. The apparatus of claim 1, wherein a vacuum housing applies pressure to the cavities in an amount less that about 1 inch mercury.

6. The apparatus of claim 1, wherein each of the pins includes a passage in fluid communication with the screen and the vacuum housing.

7. The apparatus of claim 6, wherein the passage in the pin directs the air blast from the air discharge mechanism into a cavity located at a discharge station.

8. The apparatus of claim 1, wherein a housing is attached to a frame and is stationary.

9. The apparatus of claim 1, wherein the rotary metering device comprises at least two vacuum housings applying vacuum to different groups of the cavities.

10. The apparatus of claim 9, wherein the at least two vacuum housings are located around a periphery of the rotatable lower disk and are configured to supply the vacuum force to different groups of the plurality of cavities; and gaps between the at least two vacuum housings such that when each of the cavities is adjacent to at least one of the gaps, the vacuum force is not applied to the cavities.

11. The apparatus of claim 10, wherein each of the plurality of cavities rotates through at least one of the gaps after being loaded with MST and before the MST is ejected from each of the plurality of cavities.

12. The apparatus of claim 11, wherein each of the cavities rotates through the at least one of the gaps to allow for substantially uniformly filled cavities while the MST is not under a vacuum force.

13. The apparatus of claim 10, wherein the at least two vacuum housings comprise:

a first vacuum housing and second vacuum housing, the first and second vacuum housings located around a periphery of the rotatable lower disk.

14. The apparatus of claim 13, wherein first vacuum housing provides a first vacuum and the second vacuum housing provides a second vacuum to the cavities after cessation of the first vacuum.

15. The apparatus of claim 1, comprising:

at least two vacuum housings, and wherein each of the plurality of cavities is subject to applications of vacuum from the at least two vacuum housings at different times, whereby the MST relaxes between pressure applications and delivery of the MST in an overly compacted condition is avoided.

16. The apparatus of claim 1, wherein the pins are configured to move vertically within the metering housing, and wherein the pins raise and lower the screen so as to increase or decrease a fill volume of the plurality of cavities.

* * * * *